United States Patent [19]

Shoda et al.

[11] Patent Number: 4,907,371

[45] Date of Patent: Mar. 13, 1990

[54] AUTOMATIC POLISHING MACHINE

[75] Inventors: Isao Shoda, Shizuoka; Takeshi Fujinawa; Toshikuni Yazawa, both of Aichi, all of Japan

[73] Assignees: Mitsubishi Jukogyo Kabushiki Kaisha; Shoda Iron Works Corporation

[21] Appl. No.: 291,932

[22] Filed: Dec. 30, 1988

[51] Int. Cl.[4] ..... B24B 7/02

[52] U.S. Cl. ..... 51/33 R; 51/34 R; 51/34 C; 51/34 G; 51/34 E; 51/45; 51/165.71; 51/165.75; 51/165.76

[58] Field of Search ..... 51/33 R, 34 C, 34 E, 51/ 34 G, 34 J, 34 K, 35, 45, 165.71, 165.75, 165.76, 165 R

[56] References Cited

U.S. PATENT DOCUMENTS 3,859,760 1/1975 Grieb ..... 51/165.75
4,617,764 10/1986 Reibakh ..... 51/33 R

FOREIGN PATENT DOCUMENTS 0226264 10/1986 Japan ..... 51/165 R
0257752 11/1986 Japan ..... 51/165.71

*Primary Examiner*—Frederick R. Schmidt
*Assistant Examiner*—Jack Lavinder
*Attorney, Agent, or Firm*—Sughrue, Mion, Zinn, Macpeak & Seas

[57] ABSTRACT

An automatic polishing machine which can polish a curved skin of a large area fully automatically and efficiently along a three-dimensional plane of the skin. The machine comprises a fixed horizontal beam, a movable table movable in a horizontal direction perpendicular to the beam for receiving thereon a work to be polished, a carriage mounted for movement on the beam, a slider mounted for up and down movement on the carriage, a turning member mounted for forward and backward turning movement within a predetermined angular range on an arcuate rail which is located at a lower end portion of the slider and has an upwardly swollen arcuate configuration, a rocking member mounted for up and down rocking motion on the turning member, a spindle supported for rotation on the rocking member, and a buff removably mounted on the spindle. The movable table, carriage and slider are moved by respective motors to move the buff to an aimed position, and the turning member is moved by another motor to move the buff to an aimed inclined position.

5 Claims, 8 Drawing Sheets

AUTOMATIC POLISHING MACHINE

BACKGROUND OF THE INVENTION

1. Field of the Invention

This invention relates to an automatic polishing machine which is used to polish a surface of a skin or the like, for example, of a body of an airplane.

2. Description of the Prior Art

Equipment is conventionally provided for automatically polishing a surface of a flat metal plate of a comparatively small size or a cylindrical or tubular work machined by a machine tool for finishing. In such conventional equipment, a rotating buff and a work to be polished are commonly moved relative to each other in a plane, and accordingly, it is impossible in practical use to polish a metal plate, such as a skin of a body of an airplane, which is long and wide and is curved significantly in three dimensions. Therefore, such a skin is polished by a manual operation using a portable electrically driven polishing apparatus wherein a buff is only rotated by a motor. However, the operation is a very heavy and time-consuming cumbersome operation because an area to be polished is very large.

SUMMARY OF THE INVENTION

It is an object of the present invention to provide an automatic polishing machine which can polish a curved skin of a large area fully automatically and efficiently along a three-dimensional plane of the skin.

In order to attain the object, according to the present invention, there is provided an automatic polishing machine which comprises a horizontal beam extending between upper portions of a pair of fixed vertical columns, a movable table for receiving thereon a work to be polished, the movable table being movable in a horizontal direction perpendicular to the beam, a carriage mounted for movement along a horizontal rail on the beam, a carriage driving mechanism including a motor for moving the carriage on the beam, a slider mounted for up and down movement on the carriage, a slider driving mechanism interposed between the carriage and the slider and including a motor for moving the slider up and down on the carriage, a turning member mounted for forward and backward turning movement within a predetermined angular range on an arcuate rail which is located at a lower end portion of the slider and has an upwardly swollen arcuate configuration, a turning member driving mechanism interposed between the turning member and the slider and including a motor for turning the turning member along the arcuate rail, a rocking member mounted for up and down rocking motion on the turning member, a spindle supported for rotation on the rocking member and connected to be rotated by a buffer rotating motor carried on the rocking member, and a buffer removably mounted on the spindle.

With the polishing machine, the position of a work can be changed forwardly or backwardly by moving the movable table forwardly or backwardly perpendicularly to the beam. If the carriage is moved leftwardly or rightwardly on the beam, the buffer is moved leftwardly or rightwardly in an integral relationship with the carriage. If the slider is moved upwardly or downwardly, the buffer is also moved upwardly or downwardly in an integral relationship with the slider. If the turning member is turned, the buffer is inclined. Since the spindle for carrying and rotating the buffer thereon is supported for rotation on the rocking member, also the buffer can be rocked upwardly or downwardly.

Accordingly, a surface of a work can be polished in its longitudinal direction, that is, in the leftward and rightward direction perpendicular to the beam by moving the carriage in the leftward or rightward direction. To the contrary, by moving the movable table in the forward or backward direction perpendicular to the beam, the polishing position can be changed forwardly or backwardly. By moving the slider upwardly or downwardly and turning the turning member, even a curved portion of the work can be polished.

The automatic polishing machine may further comprise a touch sensor assembly removably mounted on the slider in exchange for the buffer and having a probe for contacting with a surface of a work to electrically detecting a height of the surface of the work. Where the touch sensor assembly is removably mounted on the slider in place of the buffer, height of a curved surface of a work, curvature of the curve and so on can be measured prior to an intended polishing operation. Data of such measurement will enable fully automatic appropriate polishing operation conforming to a configuration of the surface of the work using a technique of computerized numeric control (hereinafter referred to briefly as CNC).

Preferably, the carriage driving mechanism further includes a rack mounted on the beam and a pinion mounted on the carriage and held in meshing engagement with the rack, and the motor of the carriage driving mechanism is connected to rotate the pinion to move the carriage on the beam.

Meanwhile, the slider driving mechanism preferably includes, in addition to the motor which is mounted on the carriage, a screw shaft connected to be rotated by the motor, a female thread element on the slider held in threaded engagement with the screw shaft, and a rail for guiding the slider when the slider is moved upwardly or downwardly by rotation of the screw shaft.

Further, the turning member driving mechanism preferably includes, in addition to the motor which is mounted on the slider and the arcuate rail mounted on the slider for guiding the turning member, a worm supported for rotation on the slider and connected to be rotated by the motor, and a worm gear mounted on the turning member and held in meshing engagement with the worm, whereby the turning member is turned along the arcuate rail by rotation of the worm.

Where the spindle is supported for rotation on an oscillator mounted on the rocking member and the oscillator is connected to be oscillated in a direction of an axial line of the spindle by the buff rotating motor carried on the rocking member, the buff can be oscillated in the direction of the axial line thereof while being rotated, thereby improving the polishing property of the automatic polishing machine.

Where an additional shock absorber is interposed between the rocking member and the turning member, the buff can be contacted moderately with a work and transmission of vibrations of the buff by the oscillator to the turning member, slider and so on can be prevented. Besides, excessive rocking motion of the rocking member can be checked.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
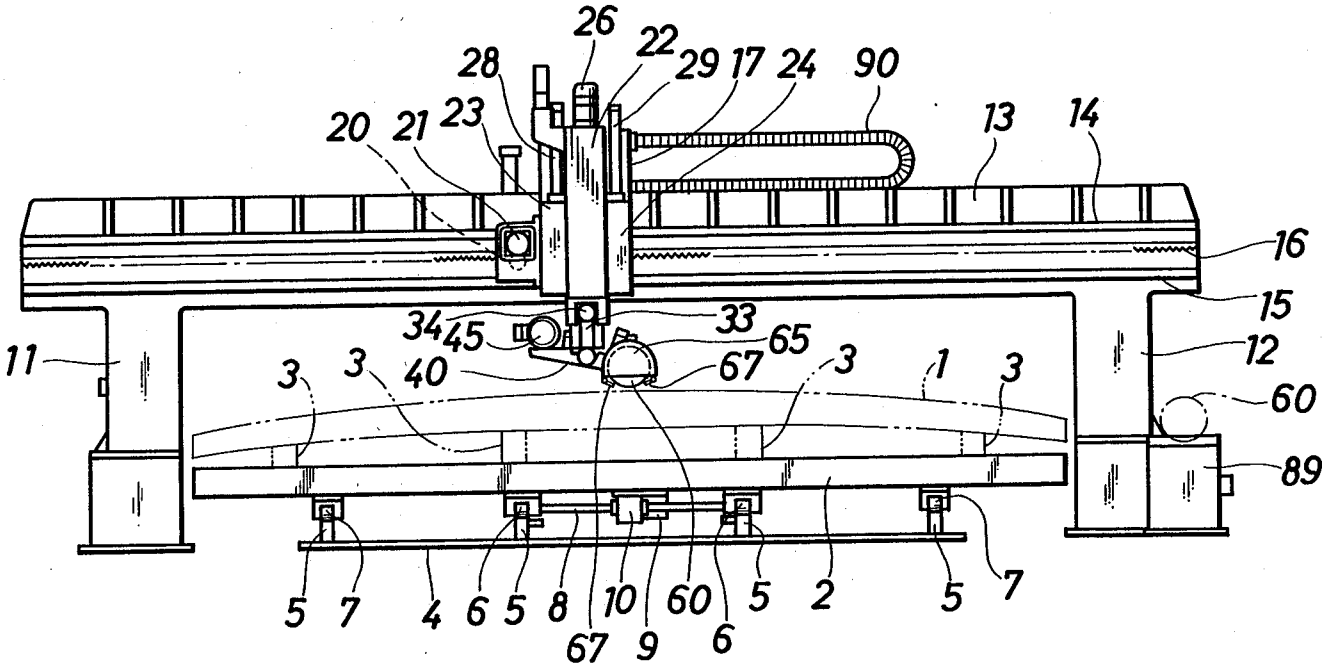
FIG. 1 is a front elevational view of an automatic polishing machine according to the present invention.
Figure 2:
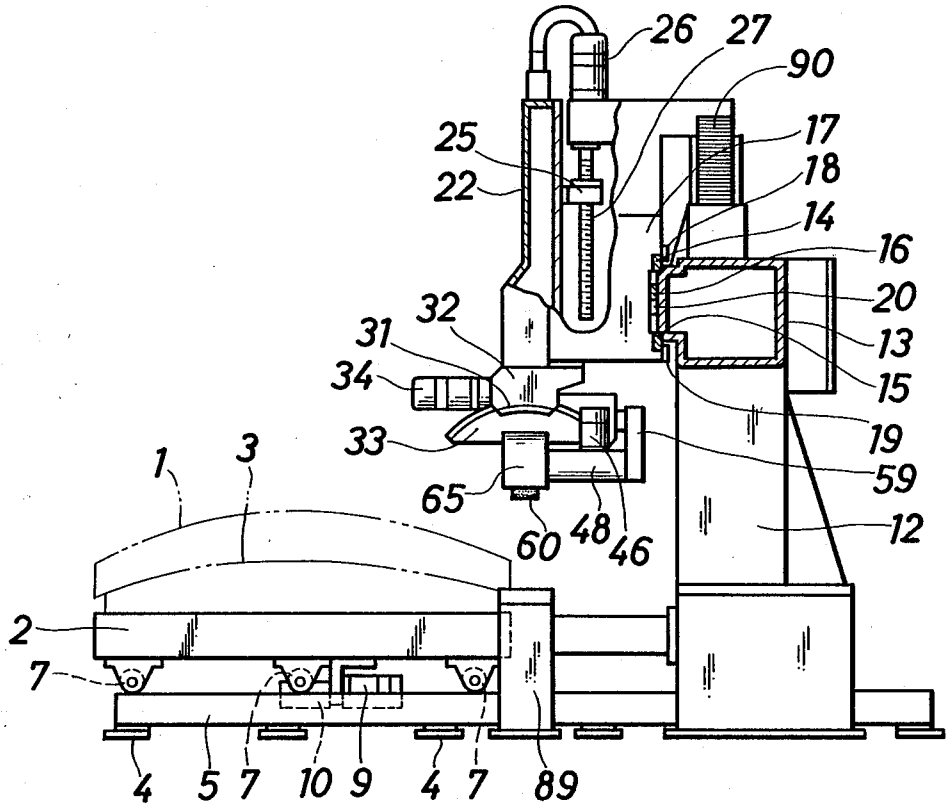
FIG. 2 is a side elevational view, partly in section, of the automatic polishing machine of FIG. 1.

Referring first to FIGS. 1 and 2, there is shown in a rather schematic representation an entire automatic polishing machine according to the present invention. The automatic polishing machine shown includes a movable table 2 for carrying a skin 1 of a body of an airplane thereon. Since such a skin 1 is curved significantly, it is placed on the movable table 2 using a plurality of arcuate-shaped seats 3. A pair of left and right driving wheels 6 and a large number of free wheels 7 are mounted for rotation on a lower face of the movable table 2 and located to roll on four rails 5 which are installed in a parallel and predetermined leftwardly and rightwardly spaced relationship on a base 4. An axle 8 for the driving rollers 6 is connected by way of a transmission gear within a gear box 10 to a bi-directional servomotor 9 mounted on the lower face of the movable table 2 so that rotation of the servomotor 9 may be transmitted at a reduced speed to the axle 8. Accordingly, when the servomotor 9 is rotated in a forward or reverse direction, the movable table 2 is moved in a forward or rearward direction, that is, in the leftward or rightward direction in FIG. 2, along the rails 5.

A beam 13 is supported at and extends horizontally between top ends of a pair of left and right fixed vertical columns 11 and 12 located leftwardly and rightwardly of the movable table 2, respectively. The beam 13 and the left and right columns 11 and 12 define therein a spacing sufficiently long and wide to allow the movable table 2 and a skin 1 placed on the movable table 2 to pass forwardly and backwardly through the spacing as can be apparently seen in FIG. 1. A pair of upper and lower leftwardly and rightwardly elongated rails 14 and 15 and a rack 16 are mounted horizontally on a front vertical face of the beam 13. A vertically elongated hollow carriage 17 is mounted for sliding movement in the leftward and rightward directions along the rails 14 and 15 on the front face of the beam 13. The carriage 17 is held by a pair of upper and lower support plates 18 and 19 securely mounted on a rear face of the carriage 17 so that the carriage 17 may not come off the upper and lower rails 14 and 15. A pinion 20 is mounted on the rear face of the carriage 17 and held in meshing engagement with the rack 16. The pinion 20 is connected to be driven to rotate by another bi-directional servomotor 21 mounted on the carriage 17. Accordingly, when the servomotor 21 is rotated forwardly or reversely, the carriage 17 is moved leftwardly or rightwardly along the rails 14 and 15.

A vertically elongated slider 22 is mounted on a front face of the carriage 17 for up and down movement along a pair of left and right vertical rails 23 and 24 on the carriage 17. A female thread element 25 like a nut is mounted on a rear face of the slider 22 and held in threaded engagement with a screw shaft 27 in the carriage 17. The screw shaft 27 is connected to be rotated by a further bi-directional servomotor 26 carried on the carriage 17. Accordingly, when the servomotor 26 is driven to rotate forwardly or reversely, the slider 22 is moved up or down vertically on the carriage 17. It is to be noted that the weight of the slider 22 is almost received by a pair of left and right balancing cylinders 28 and 29 shown in FIG. 1 and is little applied to the screw shaft 27.

Figure 3:
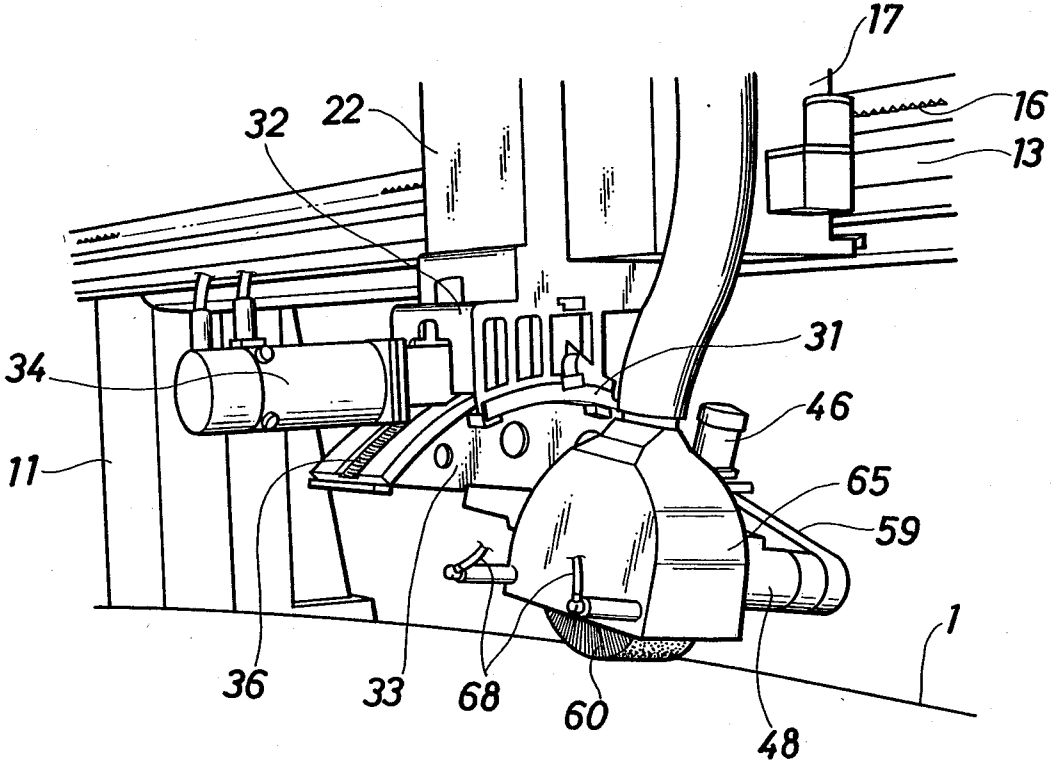
FIG. 3 is an enlarged perspective view principally showing a mechanism for oscillating, rocking, turning and lifting a buff of the automatic polishing machine of FIG. 1.
Figure 4:
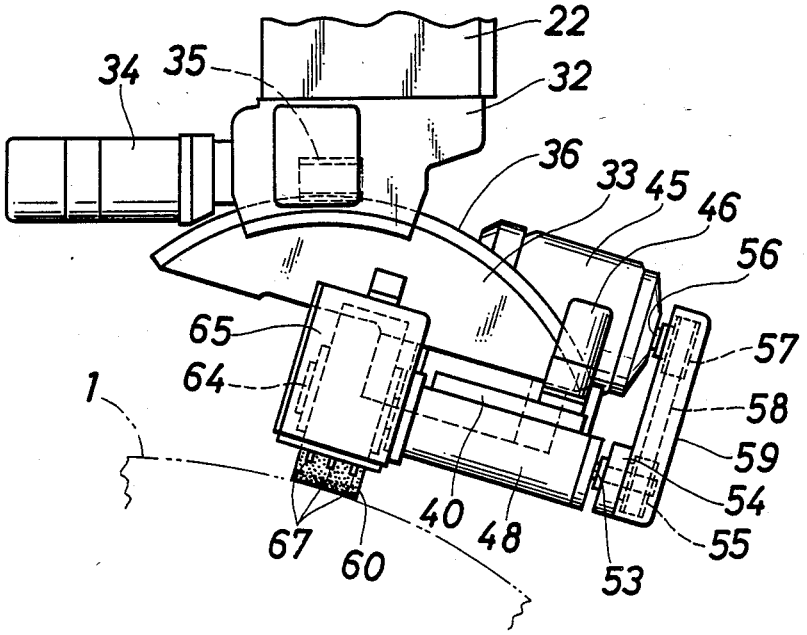
FIG. 4 is a partial side elevational view of the mechanism shown in FIG. 3.
Figure 5:
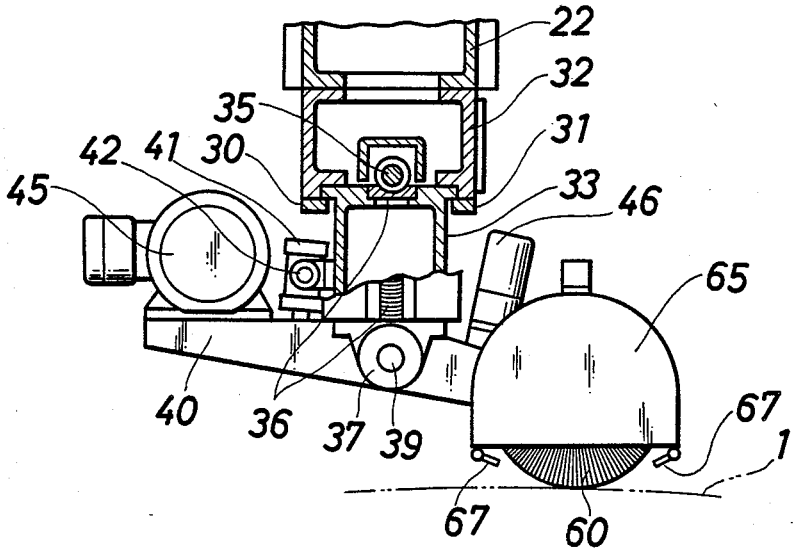
FIG. 5 is a partial front elevational view of the mechanism shown in FIG. 3 with a turning member and a slider partly broken.
Figure 6:
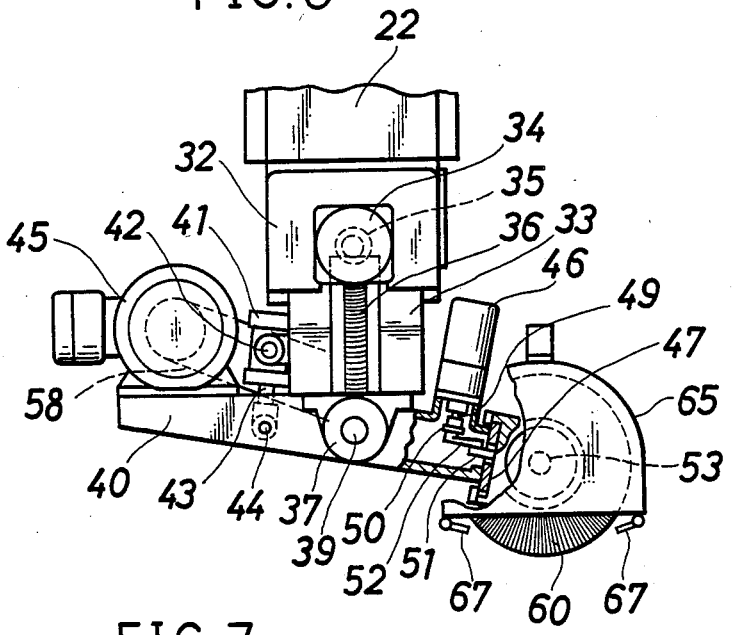
FIG. 6 is a partial front elevational view of the mechanism shown in FIG. 3 with a rocking member and an oscillator partly broken.

Referring also to FIGS. 3 to 7, a box-shaped holder 32 is securely mounted at a lower end of the slider 22 and has thereon a pair of left and right arcuate rails 30 and 31 which exhibit a configuration of an upwardly swollen arc as viewed from a side as seen in FIGS. 3 and 4. A turning member 33 having a crescent-shaped configuration as viewed from a side is mounted for turning motion in the forward and rearward directions on the arcuate rails 30 and 31, that is, for forward and backward circular movement along the arcuate rails 30 and 31. A worm 35 is supported for rotation in the holder 32 and connected to be driven to rotate by a still further bi-directional servomotor 34 mounted on an outer face of the holder 32. A worm gear 36 is provided on an arcuate upper face of the turning member 33 and held in meshing engagement with the worm 34 as seen in FIGS. 5 and 6. Accordingly, when the servomotor 34 is driven to rotate forwardly or reversely, the turning member 33 is turned forwardly or rearwardly within a predetermined angular range.

Figure 7:
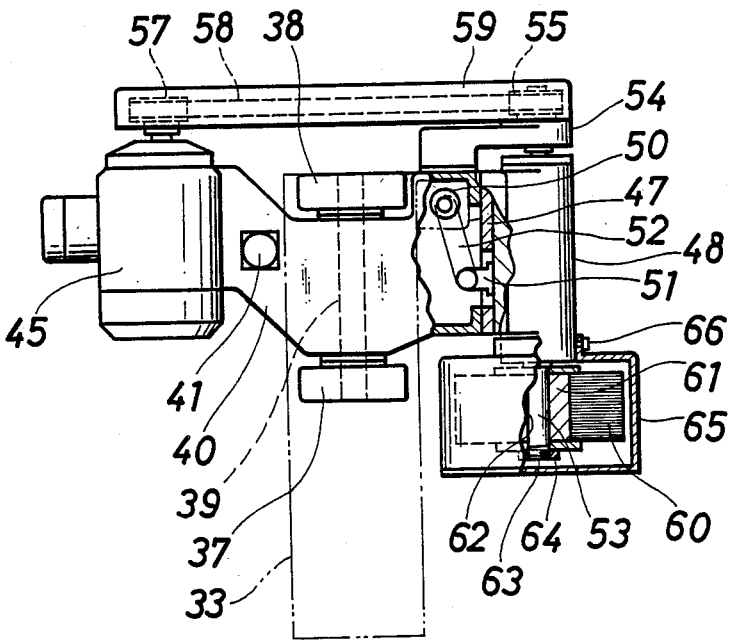
FIG. 7 is a partial plan view of the mechanism shown in FIG. 3 with the buffer, oscillator and rocking member partly broken.

A pair of front and rear bearings 37 and 38 are securely mounted on a flat lower face of the turning member 33 as shown in FIGS. 6 and 7, and a shaft 39 is supported for rotation on the bearings 37 and 38. A hollow rocking member 40 is supported for up and down rocking motion on the lower face of the turning member 33 by the shaft 39. A shock absorber 41 of a hydraulic cylinder structure is mounted for pivotal motion on a side face of the turning member 33 by means of a shaft 42 and has a piston rod 43 connected to the rocking member 40 by means of a pin 44. The shock absorber 41 acts to absorb a shock upon the rocking member 40 and restrict rocking motion of the rocking member 40. A buffer rotating motor 45 is carried on a left side portion of the rocking member 40 while an oscillation motor 46 is carried on a right side portion of the rocking member 40, and an oscillator 48 is mounted for forward and backward sliding movement on a rail 47 mounted at a right end of the rocking member 40. An eccentric cam 50 is securely mounted on a shaft 49 of the oscillation motor 46 as shown in FIGS. 6 and 7 and is connected by way of a link 52 to a bracket 51 mounted on the oscillator 48. Accordingly, when the motor 46 is rotated, the oscillator 48 is oscillated forwardly and backwardly along the rail 47.

A spindle 53 is supported for rotation on the oscillator 48 and also for forward and backward oscillating motion in an integral relationship with the oscillator 48. The spindle 53 extends through the oscillator 48 and has front and rear end portions projected forwardly and rearwardly from the oscillator 48 as seen in FIGS. 4 and 7. The rear projected end portion of the spindle 53 further extends through a thrust bearing 54 securely mounted on a rear face of the rocking member 40 and also through a pulley 55 supported for rotation on the thrust bearing 54. The pulley 55 is mounted on the spindle 53 such that the former may rotate in an integral relationship with the latter but may not receive a thrust of the latter. A belt 58 extends between the pulley 53 and another pulley 57 securely mounted on a shaft 56 of the buffer rotating motor 45 so that the spindle 53 is driven to rotate by the motor 45. The belt 58 and the pulleys 55 and 57 are covered with a cover 59.

A buffer 60 is removably mounted at the forward projected end portion of the spindle 53. In particular, as shown in FIG. 7, the forward projected end portion of the spindle 53 is fitted in an axial bore 62 of a core 61 of the buffer 60, and a nut 64 is screwed onto a threaded portion 63 of the spindle 53 to secure the buffer 60 to the spindle 53. A hood 65 for covering the buffer 60 is secured to a forward end of the oscillator 48 by means of a fastening screw 66. A plurality of nozzles 67 are mounted on the opposite left and right sides of a lower end of the hood 65 so that abrasives of powder and/or liquid may be jetted toward a lower end portion of the buffer 60 from the nozzles 67. Such abrasives may be supplied from the outside of the machine by way of a hose 68 shown in FIG. 3.

Figure 9:
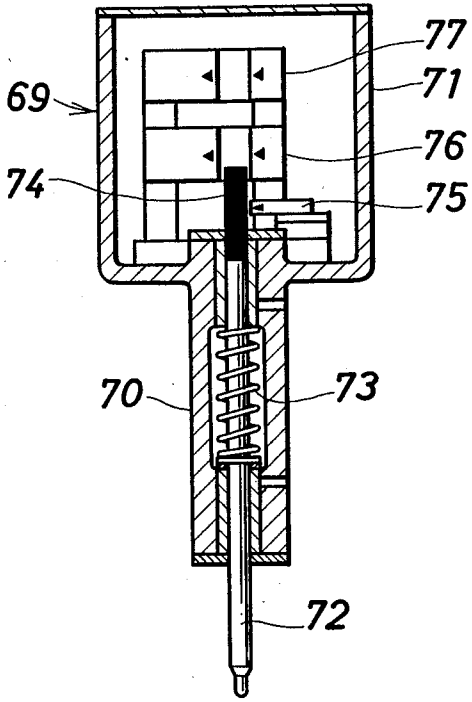
FIG. 9 is an enlarged sectional view of the touch sensor assembly shown in FIG. 8.
Figure 8:
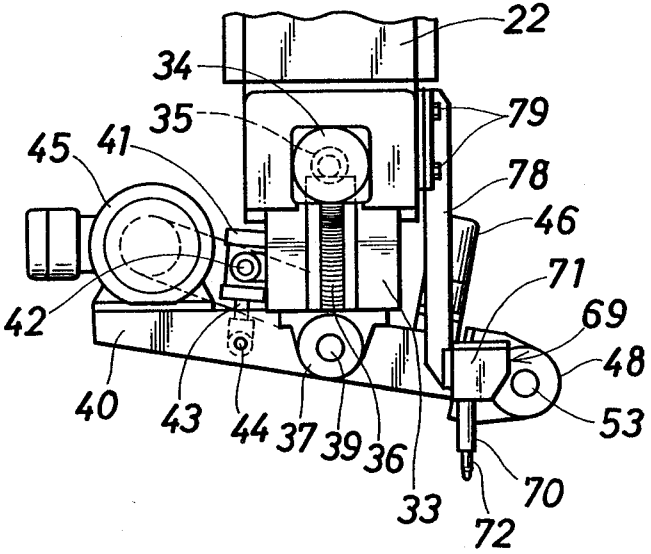
FIG. 8 is a partial front elevational view of the mechanism shown in FIG. 3 but in a condition wherein the buffer is removed and a touch sensor assembly is mounted on the slider instead.

The polishing machine is further provided with a touch sensor assembly 69 which is used while the buffer 60 and the hood 65 are removed as shown in FIG. 8. FIG. 9 shows the touch sensor assembly 69 in detail in section. Referring to FIGS. 8 and 9, the touch sensor assembly 69 includes a casing 71 having a guide cylinder 70 extending downwardly from a lower face thereof. A probe 72 is fitted for up and down sliding movement in the guide cylinder 70. The probe 72 is normally urged downwardly by a spring 73 in the guide cylinder 70 such that a lower end portion thereof may projected outwardly from a lower end of the guide cylinder 70. An upper end portion of the probe 72 is colored, for example, in black as at 74, and the colored portion 74 extends into the inside of the casing 71. A photo-interrupter 75 of the reflection type for generating a signal for measurement, another photo-interrupter 76 of the transmission type for generating a signal for deceleration and a further photo-interrupter 77 of the transmission type for generating a signal for stopping are disposed in a predetermined spaced relationship in this order from below within the casing 71.

The touch sensor assembly 69 is used to measure height and curvature of a surface of a skin 1 before the skin 1 is polished by the buffer 60 as hereinafter described. In preparation for use of the touch sensor assembly 69, a bracket 78 mounted on the casing 71 of the touch sensor assembly 69 is secured to a side face of the holder 32 by means of fastening screws 79. Thus, the touch sensor assembly 69 is removably mounted on the slider 22.

In this condition, the slider 22 is moved down. During such downward movement of the slider 22, the probe 72 is first contacted with and stopped by a surface of the skin 1. As the slider 22 is further moved down, the probe 72 is retracted into the guide cylinder 70 against the spring 73, and when the colored portion 74 of the probe 72 is spaced upwardly away from the lower photo-interrupter 75, an electric signal for measurement is developed from the photo-interrupter 75 and supplied to an electric circuit (not shown). Where a three dimensional coordinate system is considered wherein the leftward and rightward direction in which the carriage 17 is slidably moved is represented as the X axis while the forward and backward direction in which the movable table 2 is moved is represented as the Y axis and the upward and downward direction in which the slider 22 is slidably moved is represented as the Z axis, a Z axis coordinate value of the point for measurement on the surface of the skin 1 is determined from a distance over which the slider 22 is moved from a predetermined original point on the coordinate system to a position at which such a signal for measurement as mentioned above is generated. Meanwhile, an X axis coordinate value of the point for measurement is determined from a distance over which the carriage 17 is moved from the original point on the coordinate system, and a Y axis coordinate value is determined from a distance over which the movable table 2 is moved from the original point. When the probe 72 is further retracted into the guide cylinder 70 until the colored portion 74 thereof comes to a position in which it opposes to the intermediate photo-interrupter 76, a deceleration signal is delivered to the electric signal, and in response to the deceleration signal, the servomotor 26 for moving the slider 22 up and down is decelerated. When the probe 72 is further retracted into the guide cylinder 70 until the colored portion 74 thereof comes to another position in which it opposes to the upper photo-interrupter 77, a stopping signal is delivered to the electric circuit to stop the servomotor 26. Thereafter, the slider 22 is moved up to its initial position, and the carriage 17 is moved and the movable table 2 may additionally be moved to move the probe 72 to a next point for measurement, at which a similar sequence of operations will be repeated for measurement.

Figure 10:
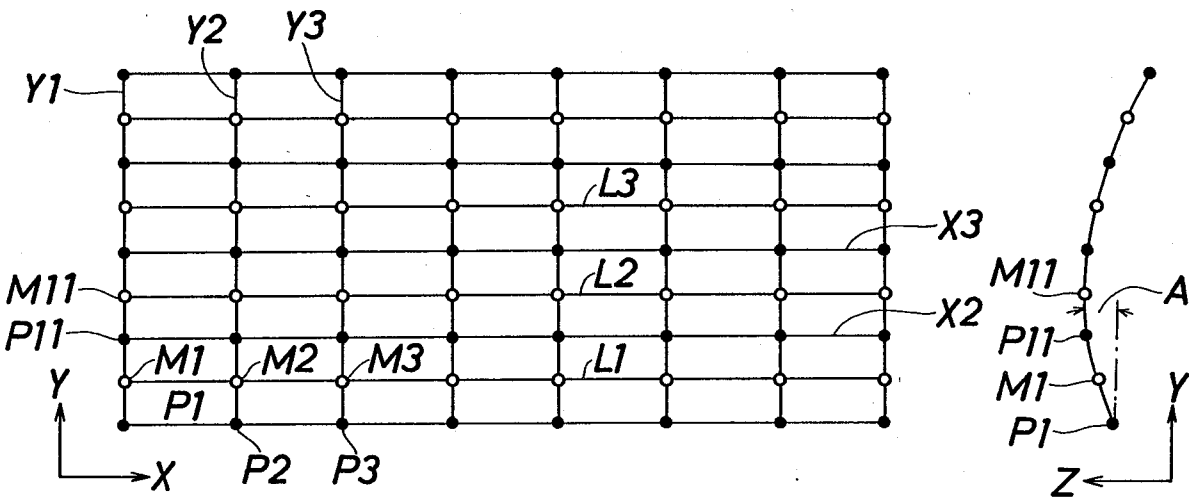
FIG. 10 is a diagram illustrating points for measurement on a coordinate system which are selectively determined when a surface of a work is to be measured by the touch sensor assembly.

FIG. 10 illustrates a concept of measurement of the skin 1. In particular, points for measurement P1, P2, P3, . . . , P11, . . . are set in rows and columns like a grating. It is assumed here that the points for measurement are disposed in a spaced relationship by a distance, for example, of 100 mm in the X axis direction and also in the Y axis direction. Thus, at each of the points for measurement, the height of the surface of the skin 1 is measured in such a manner as described above by means of the touch sensor assembly 69. The vertical position at which the touch sensor assembly 69 starts its measuring cycle varies among various points for measurement and is automatically adjusted in accordance with the height of the preceding point for measurement. In particular, when the touch sensor assembly 69 is to be moved from a point for measurement to a next point for measurement, at first it is discriminated from results of preceding measurements whether the curved face of the skin 1 is an ascending curved face or a descending curved face, and then the vertical position at which subsequent measurement is to be started is adjusted by the slider 22 in accordance with such discrimination.

Figure 11:
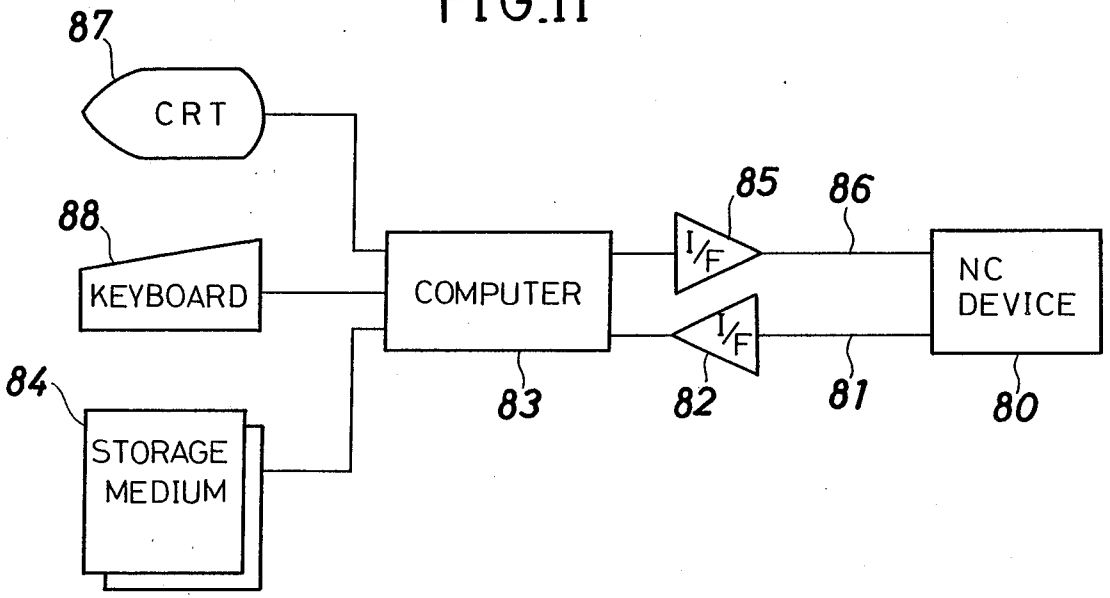
FIG. 11 is a block diagram illustrating a CNC system for controlling the automatic polishing machine.

FIG. 11 illustrates, in block diagram, a concept of a CNC system for controlling the polishing machine described above. All of the motors of the polishing machine mentioned hereinabove are controlled by an NC (numerical control) device 80. Also, signals from the touch sensor assembly 69 are processed by the NC device 80, and the signals thus processed are transmitted as measurement data to a computer 83 such as a personal computer by way of a communication cable 81 and an interface 82 and stored into a storage medium 84 such as a floppy disk or a hard disk. The personal computer 83 calculates coordinate values for polishing by the buffer 60 from the thus stored measurement data, and the data of the calculated coordinate values are also stored into the storage medium 84. In the concept illustrated in FIG. 10, the buffer 60 is moved in the X axis direction along each of intermediate horizontal lines L1, L2, L3, . . . between adjacent horizontal lines X1, X2, X3, . . . which interconnect the points for measurement P1, P2, P3, . . . , P11, . . . in the X axis direction. Accordingly, intermediate points M1, M2, M3, . . . between adjacent points for measurement P1, P2, P3, . . . , P11, . . . on vertical lines Y1, Y2, Y3, . . . which interconnect the points for measurement P1, P2, P3, . . . , P11, . . . in the Y axis direction. Further, at each of the intermediate points M1, M2, M3, . . . , an angle A of the surface of the skin 1 is calculated from Z axis coordinate values of two adjacent points for measurement on the opposite sides of the intermediate point in the Y axis direction. The angle A is employed as an inclination of the buffer 60, that is, as a reference angle when the spindle 53 is to be inclined in a subsequent polishing operation which will be hereinafter described. Such measurement processing as described above is executed in accordance with a measurement program of the personal computer 83. The measurement program is transmitted to the NC device 80 by way of another interface 85 and another communication cable 86, and the NC device 80 thus controls the servomotors of the polishing machine in accordance with the measurement program.

In order to perform a polishing operation, at first the touch sensor assembly 69 is removed, and then the buffer 60 is mounted on the spindle 53 and the hood 65 for the buffer 60 is mounted on the oscillator 48. Then, a polishing menu is selected by way of a keyboard 88 from among a plurality of menus indicated on a CRT (cathode ray tube) display unit 87 connected to the personal computer 83. After such selection, the personal computer 83 reads stored data from the storage medium 84, processes the data in accordance with a polishing program and then sends them to the NC device 80 by way of the interface 85 and the communication cable 86. The NC device 80 thus controls the aforementioned motors in accordance with the polishing program. The polishing operation proceeds, for example, in the following manner.

Referring to FIG. 10, the skin 1 is moved in the Y axis direction by the movable table 2 while the carriage 17 is moved in the X axis direction, and the buffer 60 is positioned at the intermediate point M1 at the left end of the first intermediate horizontal line on the surface of the skin 1. In this instance, if the skin surface is curved at the intermediate point M1, then the turning member 33 is turned forwardly or backwardly by a predetermined angle to incline the buffer 60 so that the axial line thereof may extend in parallel to a tangential line to the skin surface. In this condition, the slider 22 is moved down until the buffer 60 is contacted with the skin surface at first at the intermediate point M1. It is to be noted that the buffer 60 is already being rotated by the buffer rotating motor 45 and oscillated forwardly and backwardly by the oscillator 48. Then, the carriage 17 is moved in the X axis direction from the intermediate point M1 to move the buffer 60 in the rightward direction in FIG. 10 along the intermediate horizontal line L1. In this instance, the inclination of the buffer 60 is changed, before the next intermediate point M2 is reached, to another angle A which is calculated for the next intermediate point in such a manner as described hereinabove. Accordingly, the buffer 60 polishes the skin surface while being oscillated forwardly and backwardly and being rotated in a condition in which the axial line maintains its parallel position to a tangential line to the skin surface. The magnitude of such oscillations is set a little greater than the distance between adjacent intermediate horizontal lines L1, L2, L3, . . . , that is, the pitch in the Y axis direction.

After the buffer 60 reaches an intermediate point at the right end of the first intermediate horizontal line L1, the skin 1 is moved in the Y axis direction by the movable table 2 until the buffer 60 comes to another intermediate point at the right end on the second intermediate horizontal line L2, whereafter the buffer 60 is moved leftwardly from the intermediate point along the intermediate line L2 to polish the skin surface in a similar manner. Such a sequence of operations will be repeated until the entire area of the surface of the skin 1 is polished.

It is to be noted that the polishing machine described above further includes a buffer dresser 89 disposed within a range of movement of the buffer 60 but outside a range of movement of the movable table 2 as seen in FIG. 1, and the buffer 60 is moved to the buff dresser 89 as shown in phantom in FIG. 1 and automatically cleaned by the latter in the course of such a polishing operation as described above. It is also to be noted that reference numeral 90 in FIGS. 1 and 2 denotes a flexible wire harness for establishing electric connection between the carriage 17 and the NC device 80.

Having now fully described the invention, it will be apparent to one of ordinary skill in the art that many changes and modifications can be made thereto without departing from the spirit and scope of the invention as set forth herein.

What is claimed is:

1. An automatic polishing machine, comprising a horizontal beam extending between upper portions of a pair of fixed vertical columns, a movable table for receiving thereon a work to be polished, said movable table being movable in a horizontal direction perpendicular to said beam, a carriage mounted for movement along a horizontal rail on said beam, a carriage driving mechanism including a motor for moving said carriage on said beam, a slider mounted for up and down movement on said carriage, a slider driving mechanism interposed between said carriage and said slider and including a motor for moving said slider up and down on said carriage, a turning member mounted for forward and backward turning movement within a predetermined angular range on an arcuate rail which is located at a lower end portion of said slider and has an upwardly swollen arcuate configuration, a turning member driving mechanism interposed between said turning member and said slider and including a motor for turning said turning member along said arcuate rail, a rocking member mounted for up and down rocking motion on said turning member, a spindle supported for rotation on said rocking member and connected to be rotated by a buffer rotating motor carried on said rocking member, means for oscillating said spindle and a buffer removably mounted on said spindle.

2. An automatic polishing machine as claimed in claim 1, wherein said carriage driving mechanism further includes a rack mounted on said beam and a pinion mounted on said carriage and held in meshing engagement with said rack, said motor of said carriage driving mechanism being connected to rotate said pinion to move said carriage on said beam.

3. An automatic polishing machine as claimed in claim 1, wherein said turning member driving mechanism includes, in addition to said motor which is mounted on said slider and said arcuate rail mounted on said slider for guiding said turning member, a worm supported for rotation on said slider and connected to be rotated by said motor, and a worm gear mounted on said turning member and held in meshing engagement with said worm.

4. An automatic polishing machine as claimed in claim 1, wherein said spindle is supported for rotation on said oscillating means mounted on said rocking member, and said osciallating means is connected so as to be oscillated in a direction of an axial line of said spindle by an oscillation motor carried on said rocking member.

5. An automatic polishing machine as claimed in claim 1, further comprising a shock absorber interposed between said rocking member and said turning member.

* * * * *